US011746575B2

(12) United States Patent
Cervone et al.

(10) Patent No.: US 11,746,575 B2
(45) Date of Patent: Sep. 5, 2023

(54) VEHICULAR DOOR HANDLE WITH MANUAL OVERRIDE STOP

(71) Applicant: Magna Mirrors of America, Inc., Holland, MI (US)

(72) Inventors: Connor G. Cervone, Byron Center, MI (US); Justin E. Sobecki, Rockford, MI (US)

(73) Assignee: Magna Mirrors of America, Inc., Holland, MI (US)

( * ) Notice: Subject to any disclaimer, the term of this patent is extended or adjusted under 35 U.S.C. 154(b) by 30 days.

(21) Appl. No.: 17/305,826

(22) Filed: Jul. 15, 2021

(65) Prior Publication Data

US 2022/0018168 A1 Jan. 20, 2022

Related U.S. Application Data

(60) Provisional application No. 62/705,798, filed on Jul. 16, 2020.

(51) Int. Cl.
*E05B 85/10* (2014.01)
*E05B 85/16* (2014.01)

(52) U.S. Cl.
CPC ..... *E05B 85/107* (2013.01); *E05B 85/16* (2013.01)

(58) Field of Classification Search
CPC ..... E05B 85/10; E05B 85/16; E05B 85/103; E05B 85/107; E05B 81/90
See application file for complete search history.

(56) References Cited

U.S. PATENT DOCUMENTS 5,123,687 A 6/1992 Pfeiffer et al.
5,371,659 A 12/1994 Pastrick et al.
5,497,305 A 3/1996 Pastrick et al.
5,497,306 A 3/1996 Pastrick
5,669,699 A 9/1997 Pastrick et al.
5,671,996 A 9/1997 Bos et al.
5,786,772 A 7/1998 Schofield et al.
(Continued)

FOREIGN PATENT DOCUMENTS

KR 102104888 B1 * 4/2020
WO WO-2020143936 A1 * 7/2020 ..... E05B 81/06

OTHER PUBLICATIONS

Merriam-Webster.com Dictionary, s.v. "preclude," accessed Apr. 13, 2023, https://www.merriam-webster.com/dictionary/preclude. (Year: 2023).*

*Primary Examiner* — Kristina R Fulton
*Assistant Examiner* — Emily G. Brown
(74) *Attorney, Agent, or Firm* — HONIGMAN LLP

(57) ABSTRACT

A vehicular exterior door handle assembly includes a base portion and a handle portion. A bellcrank link pivotally connects the swing end of the handle portion to a bellcrank. An actuator engages a portion of a crank to impart pivotal movement of the crank to cause the crank to pivot relative to the base portion and move the handle portion from a recessed position toward a deployed position. When the handle portion is at the recessed position, the base end of the handle portion is manually movable inward to cause the swing end of the handle portion to move outward from the base portion to move the handle portion towards a manually deployed position without operation of the motor. A crank locking mechanism that limits pivotal movement of the crank when the handle portion is in the manually deployed position.

18 Claims, 10 Drawing Sheets

(56) References Cited

U.S. PATENT DOCUMENTS

| | | | |
|---|---|---|---|
| 5,823,654 | A | 10/1998 | Pastrick et al. |
| 5,929,786 | A | 7/1999 | Schofield et al. |
| 5,938,321 | A | 8/1999 | Bos et al. |
| 6,086,229 | A | 7/2000 | Pastrick |
| 6,139,172 | A | 10/2000 | Bos et al. |
| 6,149,287 | A | 11/2000 | Pastrick et al. |
| 6,152,590 | A | 11/2000 | Furst et al. |
| 6,176,602 | B1 | 1/2001 | Pastrick et al. |
| 6,198,409 | B1 | 3/2001 | Schofield et al. |
| 6,227,689 | B1 | 5/2001 | Miller |
| 6,229,233 | B1 | 5/2001 | Torii et al. |
| 6,276,821 | B1 | 8/2001 | Pastrick et al. |
| 6,280,069 | B1 | 8/2001 | Pastrick et al. |
| 6,291,905 | B1 | 9/2001 | Drummond et al. |
| 6,349,450 | B1 | 2/2002 | Koops et al. |
| 6,390,264 | B2 | 5/2002 | Torii et al. |
| 6,396,408 | B2 | 5/2002 | Drummond et al. |
| 6,416,208 | B2 | 7/2002 | Pastrick et al. |
| 6,477,464 | B2 | 11/2002 | McCarthy et al. |
| 6,550,103 | B2 | 4/2003 | Koops et al. |
| 6,568,839 | B1 | 5/2003 | Pastrick et al. |
| 6,582,109 | B2 | 6/2003 | Miller |
| 6,907,643 | B2 | 6/2005 | Koops et al. |
| 6,977,619 | B2 | 12/2005 | March et al. |
| 7,407,203 | B2 | 8/2008 | Huizenga et al. |
| 7,492,281 | B2 | 2/2009 | Lynam et al. |
| 7,581,859 | B2 | 9/2009 | Lynam |
| 7,626,749 | B2 | 12/2009 | Baur et al. |
| 7,944,371 | B2 | 5/2011 | Foote et al. |
| 8,058,977 | B2 | 11/2011 | Lynam |
| 8,333,492 | B2 | 12/2012 | Dingman et al. |
| 8,786,401 | B2 | 7/2014 | Sobecki et al. |
| 8,786,704 | B2 | 7/2014 | Foote et al. |
| 8,801,245 | B2 | 8/2014 | De Wind et al. |
| 9,605,452 | B2 | 3/2017 | Yoshino et al. |
| 9,871,288 | B2 | 1/2018 | Dykhouse |
| 10,550,611 | B2 | 2/2020 | Och |
| 10,569,697 | B2 | 2/2020 | Huizen et al. |
| 11,441,338 | B2 | 9/2022 | Blank et al. |
| 2006/0038418 | A1* | 2/2006 | Huizenga ..... E05B 79/20 292/336.3 |
| 2010/0007463 | A1 | 1/2010 | Dingman et al. |
| 2010/0088855 | A1 | 4/2010 | Ruse et al. |
| 2011/0148575 | A1 | 6/2011 | Sobecki et al. |
| 2014/0292004 | A1 | 10/2014 | Ruse |
| 2016/0298366 | A1* | 10/2016 | Och ..... E05B 85/103 |
| 2018/0106082 | A1 | 4/2018 | Brown et al. |
| 2018/0163442 | A1* | 6/2018 | Soonthornwinate .... E05B 79/06 |
| 2019/0112845 | A1* | 4/2019 | Porada ..... E05B 85/107 |
| 2020/0071973 | A1* | 3/2020 | Han ..... E05B 85/107 |
| 2020/0087956 | A1* | 3/2020 | Guerin ..... E05B 85/103 |
| 2020/0102773 | A1 | 4/2020 | Sobecki |
| 2020/0130646 | A1 | 4/2020 | Peterson |
| 2020/0173204 | A1* | 6/2020 | Murata ..... E05B 79/12 |
| 2021/0332620 | A1* | 10/2021 | Rhein ..... E05B 85/103 |

* cited by examiner

VEHICULAR DOOR HANDLE WITH MANUAL OVERRIDE STOP

CROSS REFERENCE TO RELATED APPLICATION

The present application claims the filing benefits of U.S. provisional application Ser. No. 62/705,798, filed Jul. 16, 2020, which is hereby incorporated herein by reference in its entirety.

FIELD OF THE INVENTION

The present invention relates to handles for vehicles and, more particularly, to an exterior handle for opening a side door and/or liftgate of a vehicle or interior handle for opening a side door and/or liftgate of a vehicle.

BACKGROUND OF THE INVENTION

A door handle for a vehicle door typically includes a handle portion that is pivotable relative to a base portion, whereby pivotal movement of the handle portion actuates a latch mechanism to open the door. Typically, a door handle is a pull strap handle with a strap handle portion that protrudes outwardly from the side of the vehicle for grasping by the person opening the door of the vehicle. The door handle portions of such door handle assemblies typically protrude outwardly from the vehicle door when in their unpulled state and have a space or recess behind the handle portion for receiving a user's fingers for grasping the handle portion.

SUMMARY OF THE INVENTION

An extendable flush door handle assembly for opening a door of a vehicle (such as a side door or rear door or liftgate of a vehicle) includes a handle portion that is disposed at a base portion attached at the door such that, when not in use to open the vehicle door, the handle portion is recessed at the door, with the outer surface of the handle portion being generally flush with or generally coplanar with (or only slightly protruding from or only slightly recessed in) the outer surface of the door panel at the door handle region of the door. An actuator of the door handle assembly is operable to extend or move the handle portion outward from the base portion and the door panel when a user is to use the handle to open the vehicle door, such as in response to a signal from a key fob or a passive entry system or the like. When so extended or moved to a deployed position, the handle may be readily grasped by the user and actuated or pulled or moved further outward to open the vehicle door. The actuator includes a motor that pivots a crank that is pivotally mounted at the base portion of the door handle assembly, whereby pivotal movement of the crank deploys or extends the handle portion. After the user releases the handle, the handle may return to its non-use or partially recessed position where its outer surface is generally flush or coplanar with (or only slightly protruding from or slightly recessed in) the outer surface of the door panel.

The door handle assembly includes a manual override feature, where a user can manually cause the door handle portion to protrude at least partially from the base portion and door panel. The door handle assembly includes a crank locking feature that locks the crank of the door handle when the handle portion is being manually extended to avoid a crashing or impact condition where the handle portion may impact the door panel or base portion when the handle portion is grasped and extended from the manually extended or deployed position.

Thus, the door handle assembly, when not in use, is in a recessed position, where an outer surface of the door handle portion is generally flush with the outer or exterior surface of the exterior panel of the vehicle door. The door handle portion cooperates with the door panel of the vehicle door to provide a generally flush, closed or uniform appearance of the door handle at the door when the door handle is not in use, with the door handle being movable or pivotable outward to a deployed position to facilitate grasping of the handle portion by a user when it is desired to open the vehicle door. The crank lock feature for manual deployment of the handle avoids crashing or impact conditions and may decrease the manual override efforts required to manually pivot the handle from the flush or retracted state to the manually deployed state.

These and other objects, advantages, purposes and features of the present invention will become apparent upon review of the following specification in conjunction with the drawings.

DESCRIPTION OF THE PREFERRED EMBODIMENTS

Figure 1:
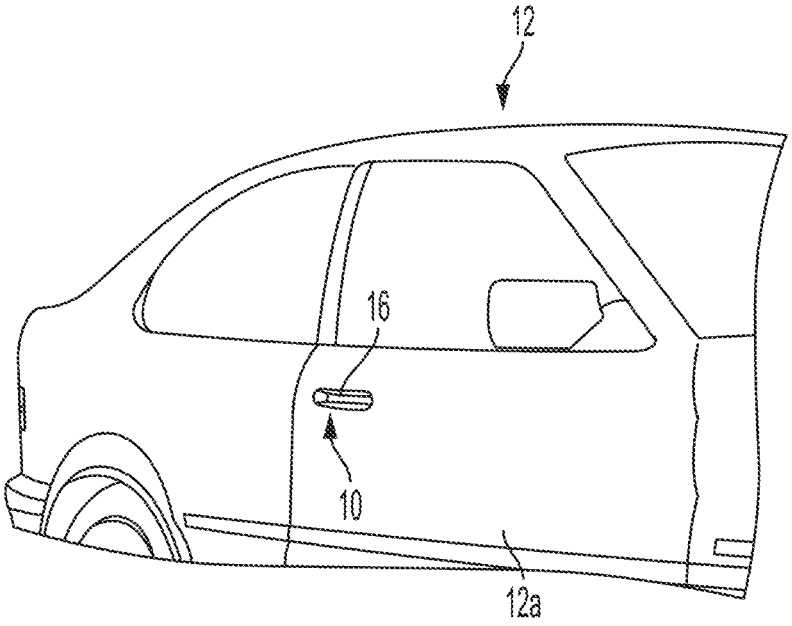
FIG. 1 is a perspective view of a vehicle with an extendable flush door handle assembly.
Figure 2:
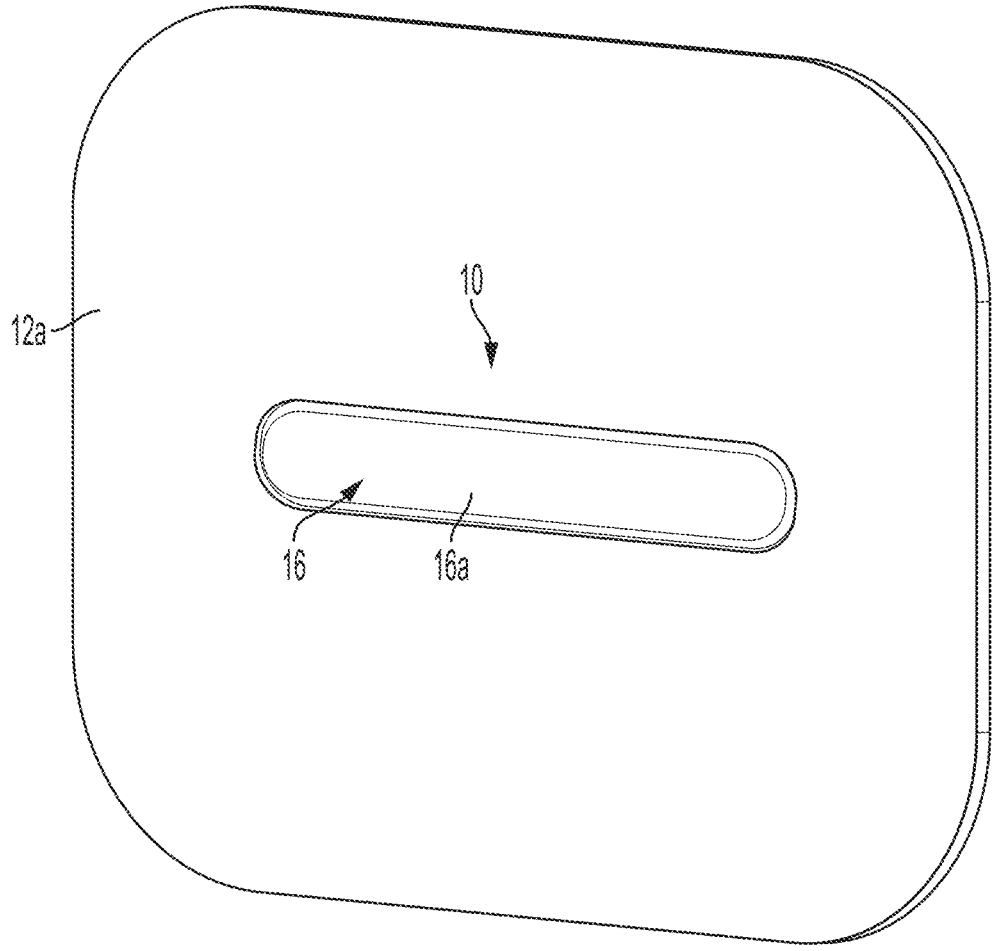
FIG. 2 is an enlarged perspective view of the extendable flush door handle assembly of FIG. 1 at the vehicle door, with the door handle in its flush or non-use or recessed position.
Figure 5:
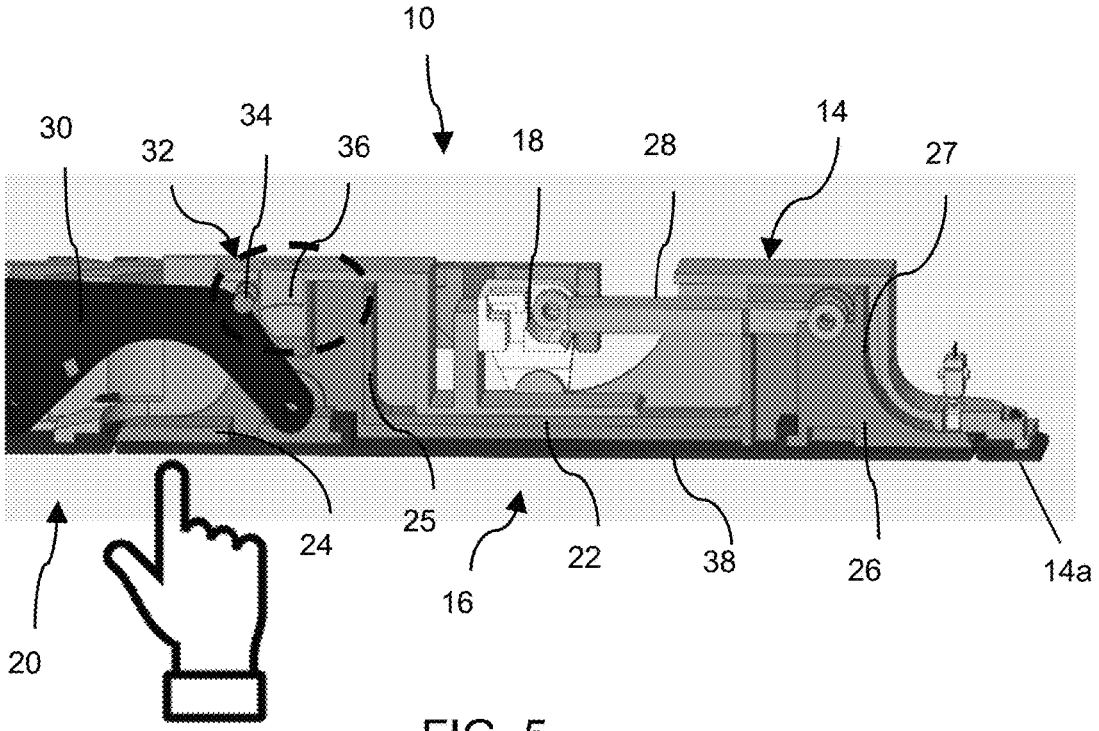
FIG. 5 is a top plan view of an extendable flush door handle assembly with a crank locking mechanism, shown with the door handle in its flush or non-use or recessed position.

Referring now to the drawings and the illustrative embodiments depicted therein, a vehicle handle assembly or module or unit or extendable flush door handle assembly 10 is mountable to a door 12*a* of a vehicle 12 and operable to release a latch mechanism of the vehicle door 12*a* to open the vehicle door (FIG. 1). The vehicle handle assembly 10 includes a base portion or bracket 14 that is mountable to a vehicle door and a handle or strap portion 16 that is pivotally mounted to the base portion 14 (FIG. 5). When not in use, the handle portion 16 is at an initial rest or recessed or non-use position and is received or disposed at or partially in the base portion 14 so that an outer surface 16*a* of the handle portion 16 is generally flush with or generally coplanar with (or protruding only slightly from or recessed slightly from) the outer surface 14*a* of the base portion 14 or the door panel 12*a*, whereby the handle portion 16 is not readily usable by a user (FIG. 2).

The handle assembly 10 may comprise any suitable type of handle assembly, and may include or incorporate aspects of the door handle assemblies described in U.S. Pat. Nos. 6,349,450; 6,977,619; 7,407,203; 8,333,492; 8,786,401 and/or 9,871,288, and/or U.S. Publication Nos. US-2020-0102773; US-2014-0292004 and/or US-2010-0088855, which are hereby incorporated herein by reference in their entireties. Optionally, aspects of the handle assembly 10 may be suitable for use with a liftgate handle assembly for a liftgate or tailgate of a vehicle.

Figure 6:
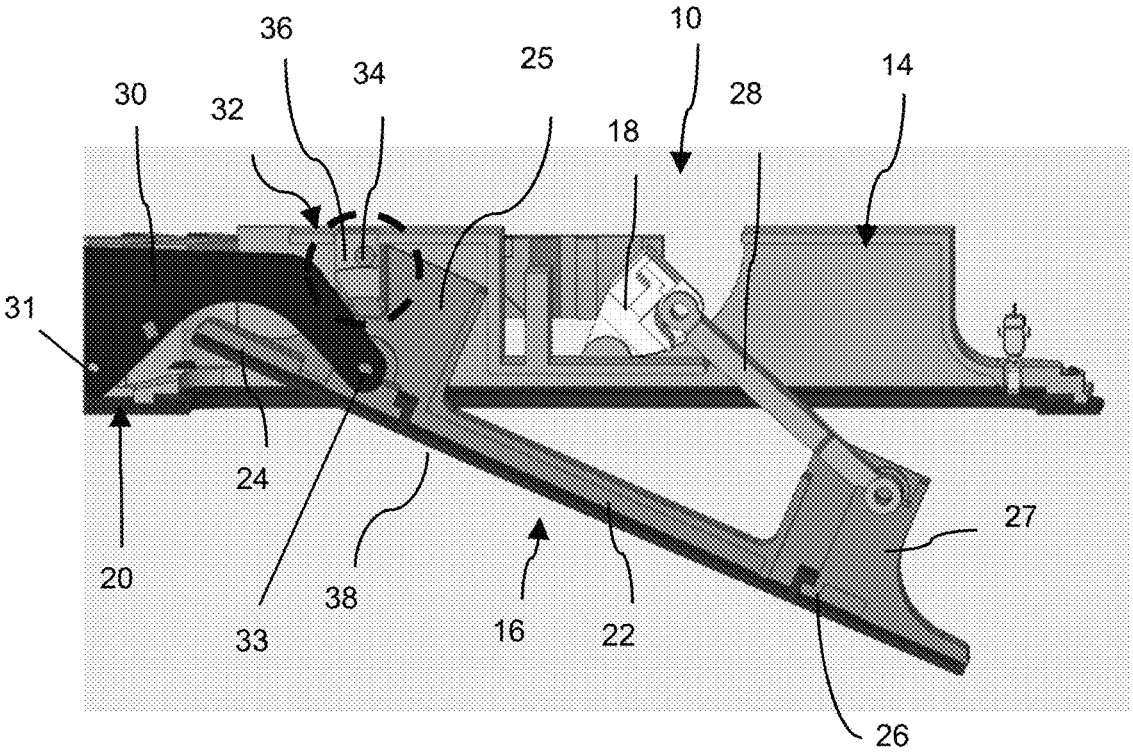
FIG. 6 is a top plan view of the extendable flush door handle assembly of FIG. 5, shown with the door handle in its manually extended position and with the crank locked.

As shown in FIGS. 5 and 6, the door handle assembly 10 includes the base portion or bracket 14 that is mountable to a vehicle door and the handle portion or strap portion 16 that is pivotally mounted to the bracket 14. The handle portion 16 is electromechanically pivotable or movable or laterally movable relative to the door and the base portion 14 to move to its ready or operational or grippable or graspable or person-operable position and is then graspable or grippable by a user to be manually moved (such as via pulling by the user) to actuate a bellcrank 18 at the base portion 14, which in turn actuates or releases the latch mechanism of the door to open the vehicle door. The door handle assembly 10 includes an electrically operable or electromechanical actuator 20 at the base portion 14 for imparting the lateral or outboard movement of the handle portion 16 relative to the base portion 14 (such as automatically imparting such handle movement in response to a signal from a key fob or a passive entry system or the like) so that the handle portion 16 is automatically moved from its recessed position to its ready or graspable position where a user can grasp the handle portion to pull or move the handle portion for unlatching and/or opening the vehicle door and/or the like, as discussed below.

The handle portion 16 includes a grasping portion 22 disposed between a base end 24 and a swing end 26 of the handle and incudes a base mounting portion 25 at the base end and a swing end mounting portion 27 at the swing end. The swing end mounting portion 27 of the handle portion 16 is pivotally mounted at a follower or connecting link 28, and the base end mounting portion 25 of the handle portion 16 is pivotally mounted at a crank 30, with the follower or connecting link 28 pivotally attached to the bellcrank 18 and the crank 30 pivotally attached at the bracket 14. The actuator 20 operates to pivot the crank 30 to extend the door handle 16 to its extended position. The concerted movement of the crank 30 and the connecting link 28 moves the handle portion 16 in and out relative to base portion 14, with the handle portion 16 remaining generally parallel to the base portion and to the surface of the door region of the vehicle door when the handle portion is moved between the recessed position and the deployed position via operation of the actuator.

The crank 30 is pivotally attached at the bracket 14 and pivotally attached at the base end mounting portion 25 of the handle 16 so that, when the actuator is operated to move the handle portion between the recessed and deployed positions, the crank 30 is pivoted relative to the bracket to swing or push the handle portion outward from the base portion 14. The handle portion 16 pivots relative to the crank 30 as the actuator operates to move the handle portion outward from the base portion to maintain a generally parallel relationship between the handle portion and the surface of the door panel. Thus, the crank 30 is pivotable about a first pivot pin or axis 31 relative to the base portion 14 and the handle portion 16 is pivotable about a second pivot pin or axis 33 relative to the crank 30. The second pivot pin 33 connects the crank 30 and the handle portion 16 at the base mounting portion 25 at a position between an end of the base end 24 and the grasping portion 22.

Additionally, the door handle assembly provides a manual override feature, which allows a user to open the vehicle door when the door handle is not extended via the actuator. For example, a user may press inward at a portion of the base end 24 of the door handle (where the hand is pointing in FIG. 5) by the crank 30 and at the opposite side of the second pivot pin or axis 33 from the grasping portion 22, whereby the handle portion may pivot about the second pivot axis 33 until the opposite or swing end 26 of the door handle extends from the bracket a sufficient amount to allow the user to grasp the door handle and pull. The pulling of the door handle pivots the bellcrank 18 via the connecting link 28 to open the vehicle door. Thus, the user may manually move the door handle to a ready position where the base end 24 is pivoted inward and the swing end is pivoted outward relative to the base portion 14, such as for situations where the vehicle power is lost (such as when the vehicle battery is dead or the like) or where the user may not be carrying the key fob or the like. The spring force or return or biasing force of a biasing element or return mechanism may be selected to provide a desired return force but not be so high as to be difficult for the user to overcome the spring force when manually moving the handle portion towards the ready position.

Figure 3:
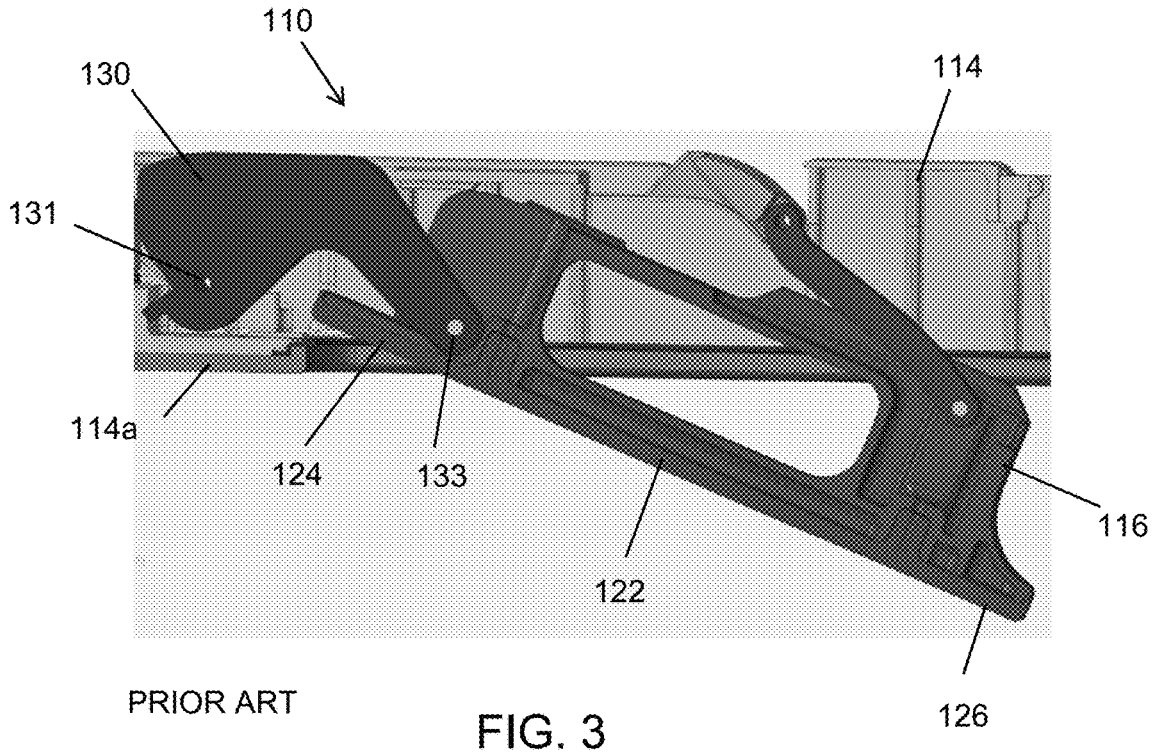
PRIOR ART FIG. 3
FIG. 3 is a top plan view of an extendable flush door handle assembly without a crank locking mechanism, shown with the door handle in its manually extended position.
Figure 4:
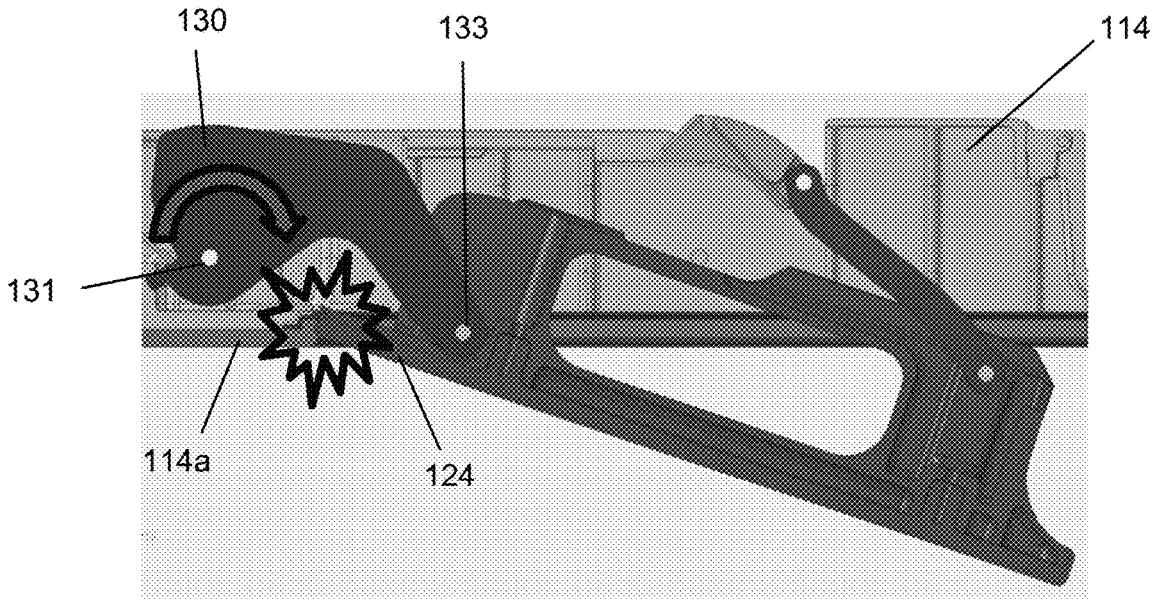
PRIOR ART FIG. 4
FIG. 4 is another top plan view of the door handle assembly of FIG. 3, showing how further manual pulling of the handle portion may lead to an impact or interference between the handle portion and the base portion or door panel.

As shown in FIG. 3, when a handle portion 116 of a door handle assembly 110 is manually pivoted at the crank 130, the base end 124 of the handle portion is pivoted inward of the outer surface 114*a* of the base portion 114 while the swing end 126 of the handle portion swings outward from the base portion. In other words, the handle pivots about the second pivot pin or axis 133 to a ready position. As shown in FIG. 4, when a user grasps the grasping portion 122 of the door handle to open the vehicle door, pulling at the handle portion when in the manually deployed position causes the crank to pivot about the first pivot pin or axis 131, which may cause the base end 124 of the handle portion to crash or impact at the outer portion or edge of the base portion or door panel.

As shown in FIGS. 5 and 6, the door handle assembly 10 includes a crank locking system or mechanism 32 that functions to lock or preclude pivotal movement of the crank 30 about the first pivot pin or axis 31 relative to the base portion 14 when the handle portion 16 is manually pivoted about the second pivot pin or axis 33 relative to the crank 30 to the ready position or manually deployed state. Precluding pivotal movement of the crank 30 relative to the base portion when the handle is manually pivoted via the crank locking mechanism 32 limits or eliminates or precludes the crashing or impact of the door handle with the base portion or door panel, as also discussed below. In the illustrated embodiment, the crank locking mechanism 32 includes a pin or protrusion 34 at an inner portion of the base end mounting portion 25 of the door handle 16 and includes a slot or receiving portion 36 at the base portion 14 that is configured to receive the pin 34 therein when the handle is pivoted during a manual override situation. As can be seen with reference to FIGS. 5 and 6, when the handle portion 16 is manually pivoted to the manually deployed position, the pin 34 pivots with the base mounting portion 25 into the slot or receiving portion 36.

Figure 7:
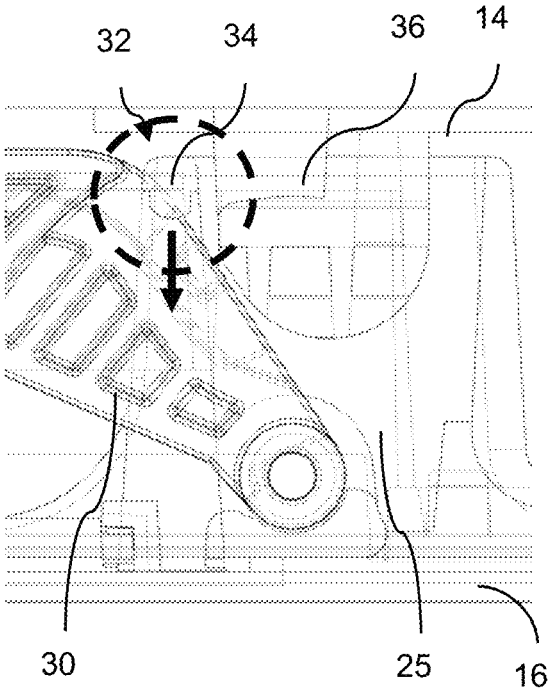
FIG. 7 is an enlarged view of the crank and locking feature, when the door handle is in its flush or non-use or recessed position.
Figure 8:
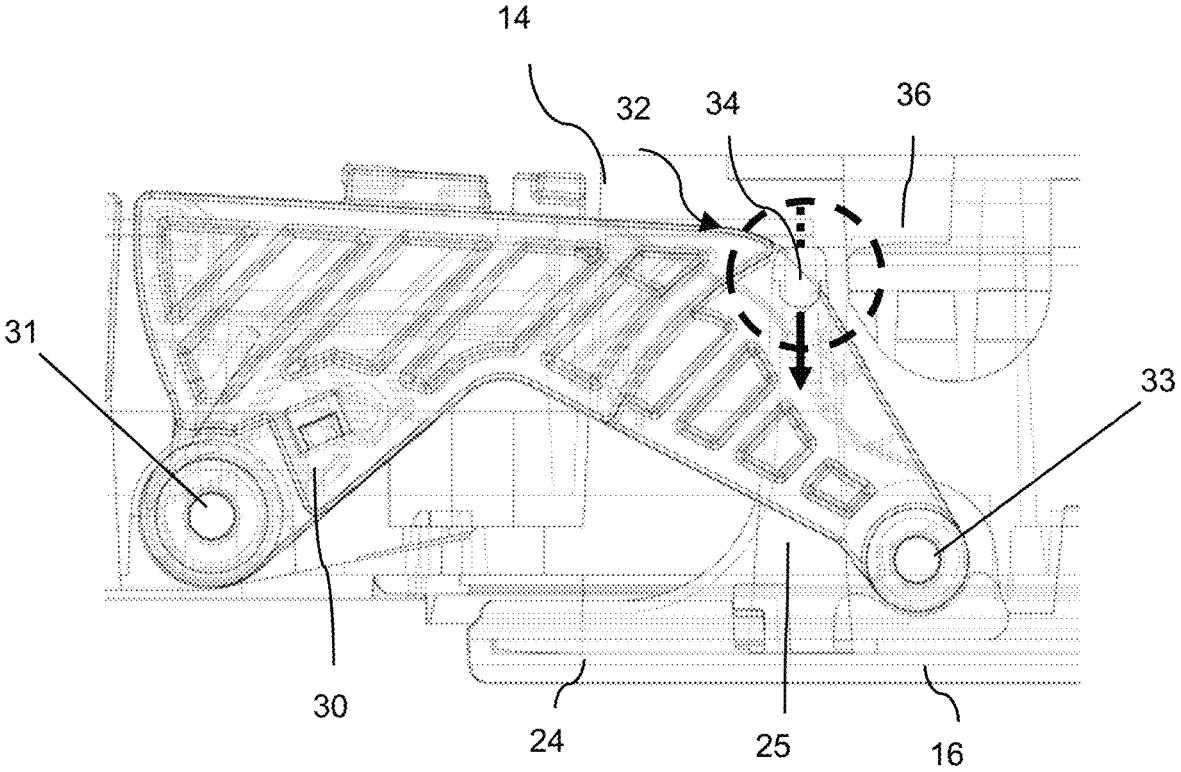
FIG. 8 is an enlarged view of the crank and locking feature of FIG. 7, when the door handle is deployed by the actuator or motor of the door handle assembly.
Figure 9:
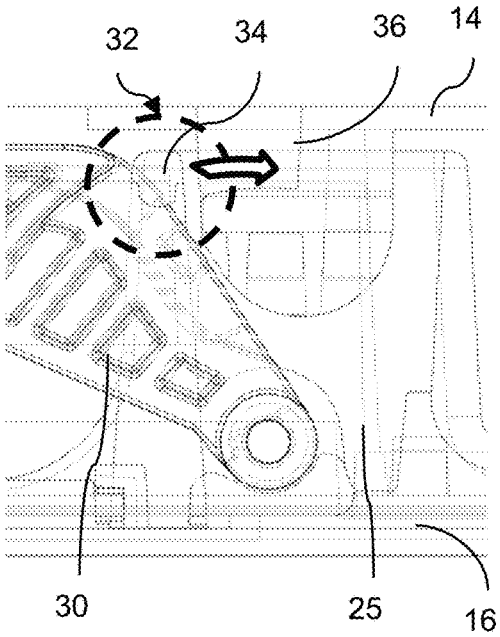
FIG. 9 is another enlarged view of the crank and locking feature, when the door handle is in its flush or non-use or recessed position.
Figure 10:
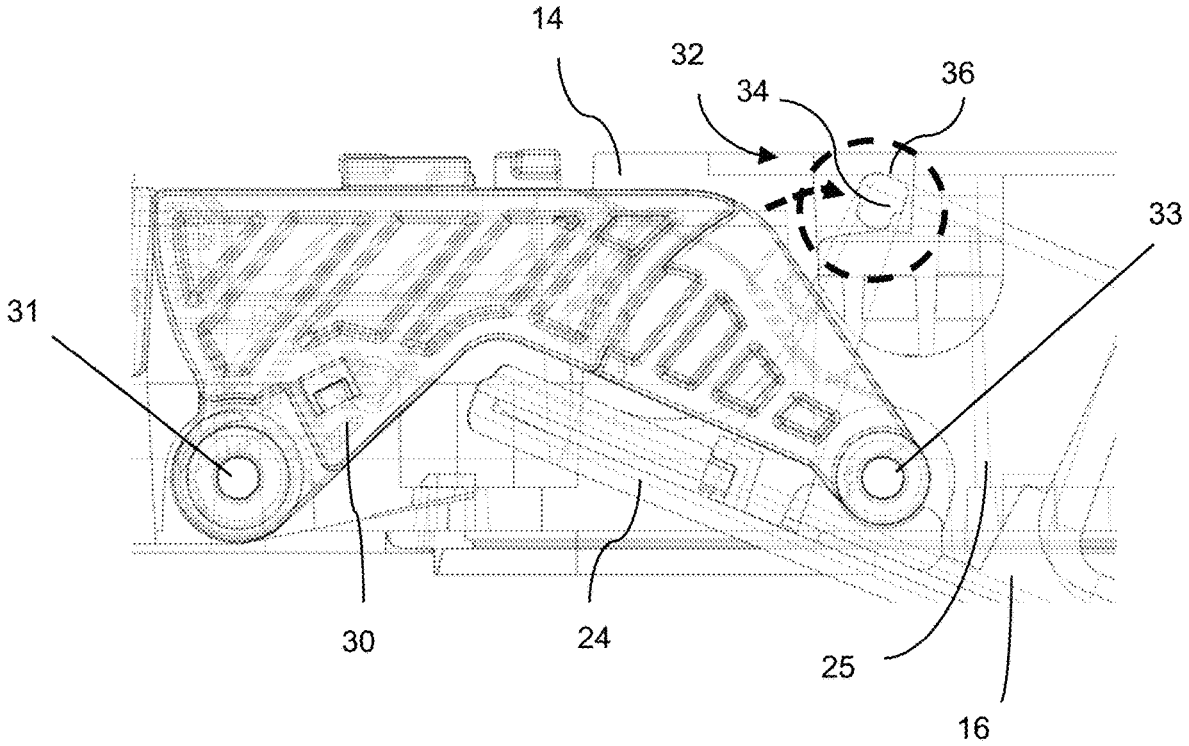
FIG. 10 is an enlarged view of the crank and locking feature of FIG. 9, when the door handle is manually deployed.

As shown in FIGS. 7 and 8, when the actuator 20 is operated to pivot the crank 30 to deploy the door handle 16, the door handle 16 moves directly outward from the base portion (downward in FIG. 7, but when the handle assembly is installed at a vehicle door, the direction would be laterally outward from the vehicle door) in a non-pivoting manner. During such outward movement, the pins or protrusions 34 at the inner portion of the base end mounting portion 25 of the door handle move outwardly (such as shown by the arrows in FIGS. 7 and 8) and do not move into the respective slots or receiving portions 36 of the base portion 14 and thus do not contact the base portion.

However, and as shown in FIGS. 5, 6, 9 and 10, when the handle is manually deployed (by pushing inward at the base end of the door handle), the door handle pivots about the second pivot pin or axis 33 (without first moving outward), which swings the pins or protrusions 34 into the receiving portions 36, which prevents the base end of the handle and thus the crank from pivoting outward when the handle portion is subsequently pulled by a user to open the door. When the handle portion is further pulled, when in the manually deployed or ready position, the handle portion pivots further about the second pivot pin or axis 33 (without pivoting the crank 30 about the first pivot pin or axis 31) to pivot the bellcrank 18 to actuate the latch to open the door.

Figure 13:
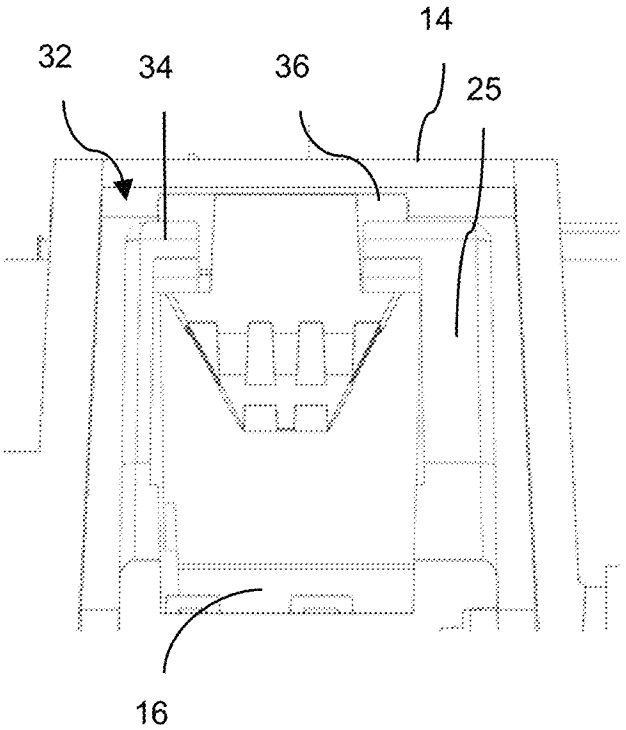
FIG. 13 is a view of the base portion and door handle of FIGS. 11 and 12.
Figure 12:
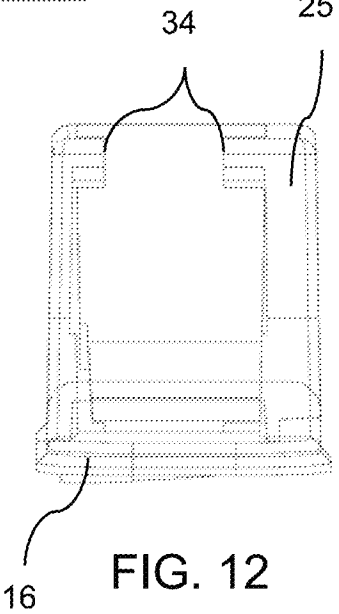
FIG. 12 is a view of the door handle, showing the locking tabs protruding inward toward one another from opposite walls of the door handle.
Figure 11:
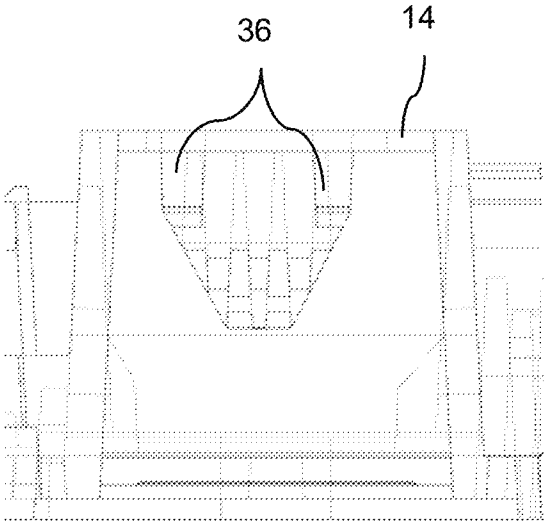
FIG. 11 is a view of the base portion of the door handle assembly, showing the slots for receiving the locking tabs of the door handle when the door handle is manually deployed.
Figure 15:
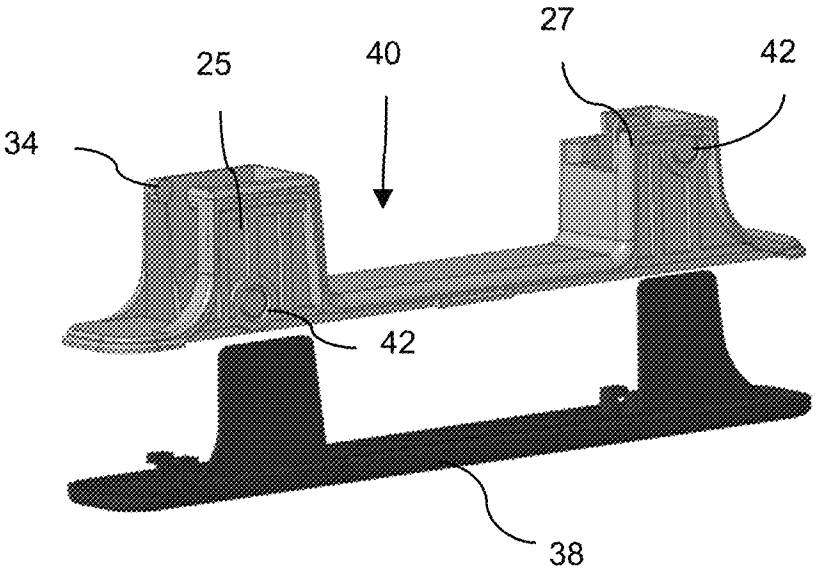
FIGS. 14-16 are exploded perspective views of the door handle, shown with a handle cap that is attached after the pins attach the door handle to the crank and counter weight.
Figure 14:
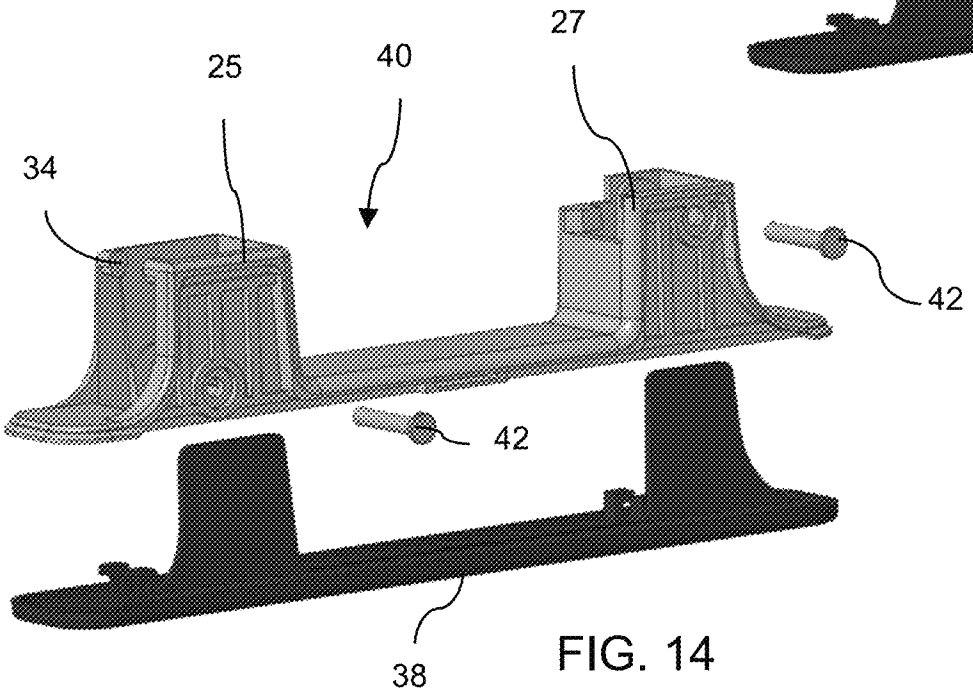
Figure 16:
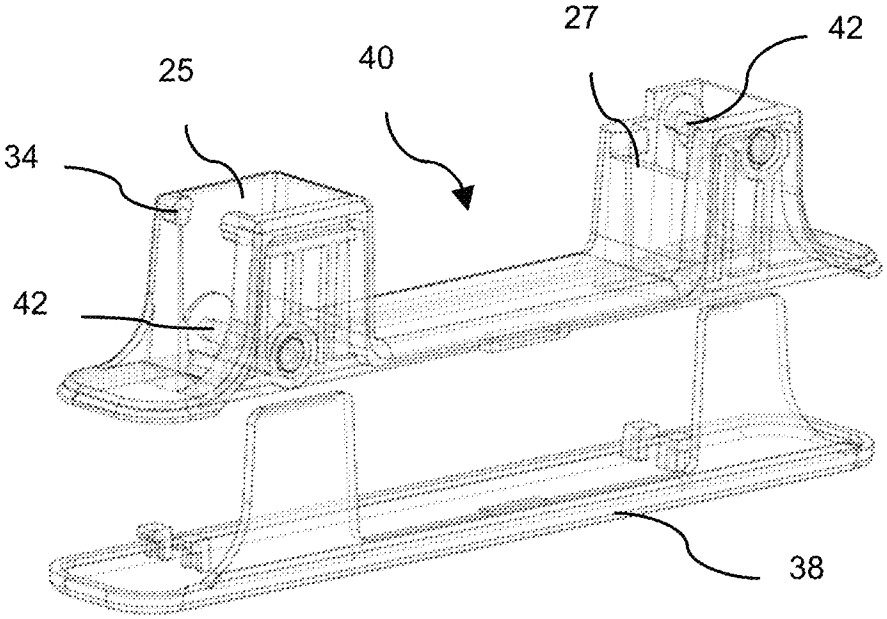
Figure 17:
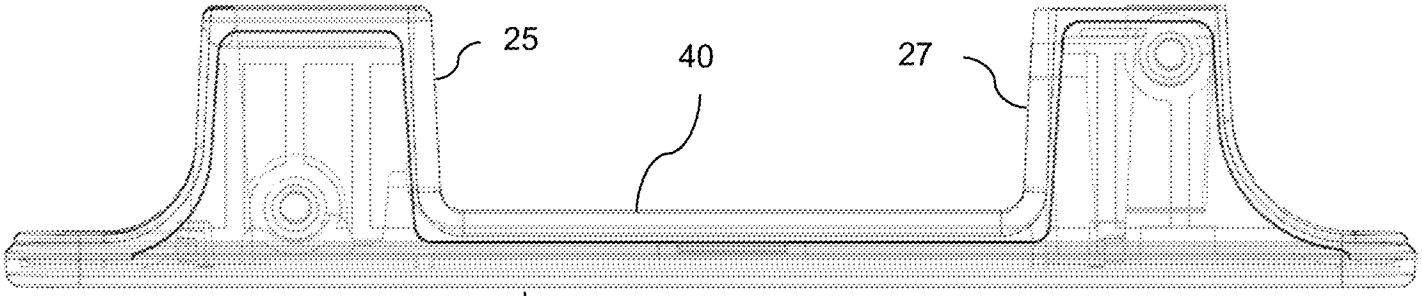
FIG. 17 is a top plan view of the door handle and handle cap assembled together.
Figure 18:
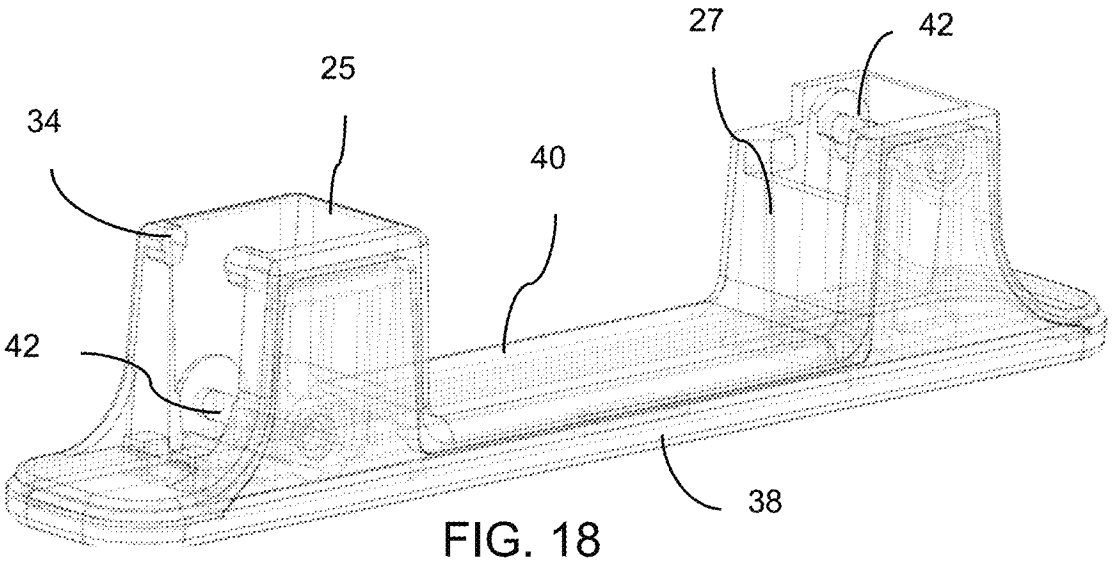
FIGS. 18 and 19 are perspective views of the door handle and handle cap assembled together.
Figure 19:
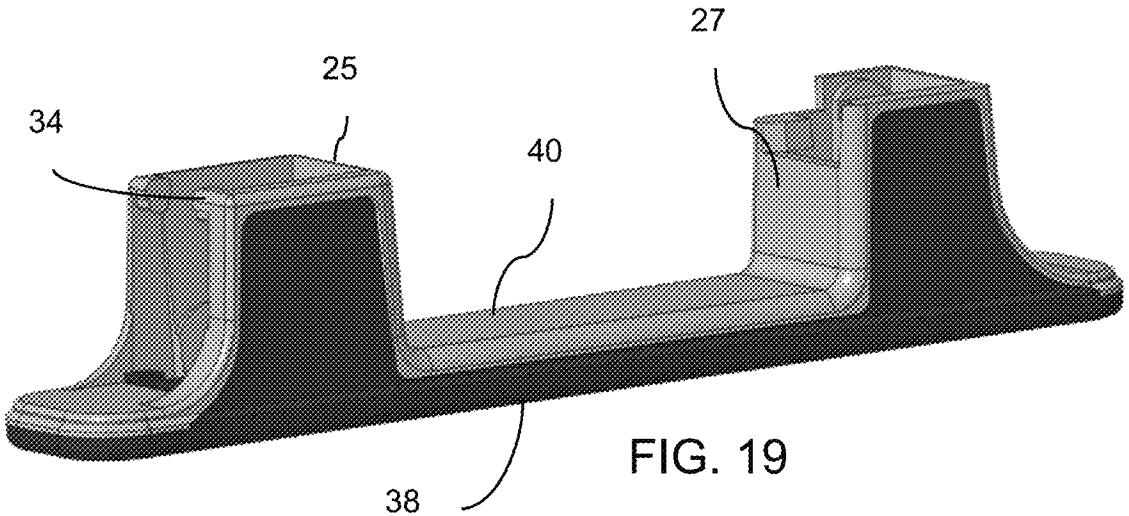

As shown in FIGS. 11-13, the bracket slots or receiving portions 36 for the handle core boss or pin or protrusions 34 are located in between the side walls of the base mounting portion 25 of the door handle, which allows for the handle core bosses 34 to be hidden in between the handle core walls, resulting in a more aesthetically pleasing look.

The handle portion 16 also includes a handle cap 38 that attaches at the exterior of a handle core portion 40 and covers the outer sides of the base mounting portion and the swing mounting portion and covers the exterior surface or side of the handle portion (that faces outward at the door panel). The handle cap may snap or otherwise attach to the handle core, such as by sliding the handle cap into place so that the tabs are received at the core portion to retain the handle cap at the handle core. As can be seen with reference to FIGS. 14-19, the handle cap 38 is attached to the handle core 40 after the handle core is pivotally attached at the crank and the connecting link, such as via pins 42. The handle cap thus is slid into place after the pins are inserted through the handle core and covers the pins for a more aesthetically pleasing look, such that the user does not see or feel any pins on the handle. The pins are inserted from the top of the handle and have an enlarged head portion that is received at a recess at the handle core, whereby the larger head portions stop the insertion of the pins and the pins cannot slide out in the opposite direction due to gravity. The handle cap 38 then covers the attaching pins and provides an aesthetically pleasing outer exposed surface for the handle.

Therefore, the handle portion of the exterior door handle assembly is movable relative to the base portion between a recessed position, where the handle portion is recessed at the base portion so as to be not graspable by a user (and with an outer surface of the grasping portion of the handle portion being generally flush or co-planar with an outer surface of the door handle region at and around the handle portion), and a deployed position, where the handle portion protrudes outward from the base portion to be graspable by the user. The crank 30 pivotally connects the base end mounting portion 25 of the handle portion 16 to the base portion 14. The bellcrank 18 is pivotally mounted at the base portion and is coupled with a door latch of the door of the vehicle. The bellcrank connecting link 28 pivotally connects the swing end connecting portion 27 of the handle portion to the bellcrank 18.

The actuator 20 includes a motor that is electrically operable in response to an input signal. Responsive to the input signal, the motor operates and the actuator engages a portion of the crank to impart pivotal movement of the crank to cause the crank to pivot relative to the base portion and move the handle portion from the recessed position toward the deployed position. As the crank pivots to move the base end of the handle portion, the bellcrank link 28 pivots relative to bellcrank and the base portion to move the swing end of the handle portion relative to the base portion 14. When the handle portion is at the deployed position, the swing end of the handle portion is manually movable further outward from the base portion to move the bellcrank link outward from the base portion to impart pivotal movement of the bellcrank relative to the base portion to open the door of the vehicle.

The door handle assembly thus provides a parallel door handle deployment, which is electrically actuated from a flush position or state to a deployed position or state. The door handle is spring-biased to return to its flush state after deployment (and after the actuator cam is rotated back to its initial position). The linkage mechanism, with the follower attached directly to the counter weight/bellcrank, causes the follower and the bellcrank to both move when the handle is pulled to activate the latch or e-latch switch.

The mechanism also allows the user to push on one side of the handle and manually deploy the handle. This will allow the user to unlatch the latch manually without using the actuator. When the handle is manually pivoted in such a manner, the crank locking mechanism is engaged to limit or preclude pivotal movement of the crank when the handle portion is pulled by the user to open the vehicle door. The crank locking mechanism thus controls the pivoting of the handle portion and limits or precludes pivoting of the crank when the handle is pulled to open the vehicle door, and thus limits or eliminates the crashing or impact condition and decreases the manual override efforts in pulling the handle to open the vehicle door.

By providing a flush or generally flush or recessed handle, the door handle assembly reduces air drag and enhances the aerodynamic performance of the equipped vehicle with a potential for enhanced fuel economy for the vehicle. When normally mounted to a vehicle door and not in use, the door handle assembly provides a generally flush mounted door handle that does not protrude from the side of the vehicle and/or does not have a pocket or recess thereat to facilitate grasping of the door handle by a person using the door handle to open the vehicle door. The actuator of the door handle assembly may cause the handle portion to extend from the vehicle when it is desired or appropriate for the user to grasp the door handle to open the vehicle door. The extension of the handle from its recessed position to its partially extended or graspable position may be responsive to any suitable trigger or signal or the like. For example, the handle may extend to its graspable position responsive to a touch or proximity of a person's hand at the door handle or at the door or the like (such as via responsive to a touch or proximity sensor disposed at the vehicle door at or near the door handle). Optionally, the movement of the handle to its partially extended graspable position may be responsive to a signal received from a remote transmitting device, such as a key fob or identifying device or the like (and the signal may comprise a radio frequency signal or infrared signal or any suitable signaling means), or may be responsive to a detection of a proximity of a device that the user may carry (which is automatically detected when it is in a detectable distance from the vehicle and does not require that the user actuate a door unlock button or the like), or may be responsive to a human action at the door (such as a touch and/or proximity of a person or person's hand at the door or door handle), or may be responsive to other passive entry type systems and/or devices. Although shown and described as being movable by an electrically operable motor and actuator, the movement of the handle from its recessed position to its graspable position may be via any suitable means, such as an electric motor or a memory wire or muscle wire or the like.

Optionally, the movement of the door handle to its partially extended or graspable position may be done in conjunction with other functions, such as activation of one or more vehicle exterior lights (such as ground illumination lights or headlights or turn signal lights or the like) or such as activation of one or more vehicle interior lights or such as actuation of the vehicle horn or other signal to alert the user that the door handle is moved to its graspable position. Control circuitry or logic to provide the dual or multiple functions can piggyback on one common control system.

Optionally, the control circuitry or logic to control or extend the handle portion may include a lockout function so that the control will not and cannot extend the handle when it is not appropriate to open the door of the vehicle. For example, the lockout function may limit or preclude extension of the door handle when the vehicle is in a forward or reverse gear or when the vehicle ignition is on or following a period of time (such as about twenty seconds or more or less) after the vehicle ignition is turned on or when the vehicle is moving at or above a threshold speed (such as, for example, at or above about three mph or about five mph or other selected threshold vehicle speed) or the like. When one or more of these conditions (and optionally one or more other conditions depending on the particular application) is detected, the control limits or precludes extension of the handle to its graspable position irrespective of receipt of other inputs, such as a door unlock button actuation or a passive entry system signal or the like.

Optionally, the door handle assembly and/or the vehicle door may include a control or control module for operating and controlling the actuator (and/or other devices or functions of the door or vehicle). For example, the door or door handle assembly may include a control module that utilizes aspects of the control modules disclosed in U.S. Pat. Publication No. US-2010-0007463, which is hereby incorporated herein by reference in its entirety.

Although shown as a strap type handle, the handle assembly may comprise any suitable type of vehicle door handle assembly, such as a paddle type vehicle door handle assembly (having a paddle or handle portion that is pivotable about a generally horizontal pivot axis to open the vehicle door) and/or such as a handle assembly of the types described in U.S. Pat. No. 6,349,450, which is hereby incorporated herein by reference in its entirety) or other type of vehicle door handle assembly. Optionally, the door handle assembly may include a soft touch handle portion, such as utilizing the principles described in U.S. Pat. No. 6,349,450, incorporated above.

Optionally, the door handle assembly may include an antenna or the like, such as for sensing or transmitting signals, such as described in U.S. Pat. No. 6,977,619, which is hereby incorporated herein by reference in its entirety. For example, the handle assembly may include an antenna or sensor (such as an antenna and/or capacitive sensor) at the handle portion and/or may include a passive entry device or element. The antenna or sensor and/or passive entry device may receive a signal from a transmitting device (such as from a key fob or the like carried by the driver of the vehicle) and/or may sense or detect the presence of or proximity of a person or person's hand at or near the door handle, and may generate an output signal indicative of such detection. The actuator may be responsive to the antenna and/or sensor and/or device to impart an outward movement of the door handle portion so that the user can grasp the handle portion to open the door of the vehicle.

Although shown and described as being a generally horizontally oriented handle portion that pivots about a generally vertical pivot axis, it is envisioned that the handle of the extendable flush door handle assembly may be oriented in any manner. For example, the handle may be oriented so that it is either vertical, horizontal, or diagonal with respect to the ground. Also, although shown and described as an exterior door handle for opening a side door or rear door or lift gate of a vehicle from exterior the vehicle, it is envisioned that the extendable flush door handle assembly may be suitable for use as an interior handle for opening a side door or rear door or liftgate of a vehicle from inside the vehicle.

Optionally, the door handle assembly or module may incorporate other features or accessories, such as, for example, a blind spot indicator device or element and/or a turn signal indicator device or element, such as by utilizing aspects of the devices described in U.S. Pat. Nos. 10,569,697; 8,801,245 and/or 8,333,492, and/or U.S. Publication No. US-2010-0007463, which are hereby incorporated herein by reference in their entireties.

Optionally, the door handle assembly or module may include or may be associated with an antenna for receiving signals from or communicating with a remote device. For example, the antenna (such as, for example, an antenna of the types described in U.S. Pat. No. 6,977,619, which is hereby incorporated herein by reference in its entirety) may communicate a signal to the door locking system via a wire connection or the like, or wirelessly, such as via a radio frequency signal or via an infrared signal or via other wireless signaling means. Such connections can include cables, wires, fiber optic cables or the like. The communication to the locking system may be via a vehicle bus or multiplex system, such as a LIN (Local Interconnect Network) or CAN (Car or Controlled Area Network) system. The vehicle door may then be unlocked and/or the illumination source or sources may be activated as a person carrying a remote signaling device approaches the door handle. Optionally, other systems may be activated in response to the remote signaling device, such as vehicle lighting systems, such as interior lights, security lights or the like, or the vehicle ignition, or any other desired system.

Changes and modifications to the specifically described embodiments may be carried out without departing from the principles of the present invention, which is intended to be limited only by the scope of the appended claims as interpreted according to the principles of patent law.

The invention claimed is:

1. A vehicular exterior door handle assembly, the vehicular exterior door handle assembly comprising:

a base portion disposed at a door handle region of a vehicle door of a vehicle;

a handle portion including a base end, a swing end, and a grasping portion disposed between the base end and the swing end, wherein the handle portion is movable relative to the base portion between a recessed position, where the handle portion is recessed at the base portion so as to be not graspable by a user, and a deployed position, where the handle portion protrudes outward from the base portion to be graspable by the user;

a crank that pivotally connects the base end of the handle portion to the base portion;

a bellcrank that is pivotally mounted at the base portion and that is coupled with a door latch of the vehicle;

a bellcrank link that pivotally connects the swing end of the handle portion to the bellcrank;

an actuator including a motor that is electrically operable in response to an input signal;

wherein, responsive to the input signal, the motor operates and the actuator engages a portion of the crank to impart pivotal movement of the crank to cause the crank to pivot relative to the base portion and move the handle portion from the recessed position toward the deployed position, and wherein, as the crank pivots to move the base end of the handle portion, the bellcrank link pivots relative to the bellcrank and the base portion to move the swing end of the handle portion;

wherein, when the handle portion is at the deployed position, the swing end of the handle portion is manually movable further outward from the base portion to move the bellcrank link outward from the base portion to impart pivotal movement of the bellcrank relative to the base portion to actuate the door latch;

wherein, when the handle portion is at the recessed position, the base end of the handle portion is manually movable inward to cause the swing end of the handle portion to move outward from the base portion to move the handle portion toward a manually deployed position without operation of the motor;

a crank locking mechanism that limits pivotal movement of the crank when the handle portion is in the manually deployed position;

wherein the crank locking mechanism comprises at least one protruding structure at the base end of the handle portion and at least one receiving structure at the base portion, and wherein the at least one receiving structure is configured to receive the at least one protruding structure when the base end of the handle portion is manually moved inward to cause the swing end of the handle portion to move outward toward the manually deployed position; and wherein, when the handle portion is in the manually deployed position and is pulled by the user to open the vehicle door, the at least one protruding structure at the base end of the handle portion engages a portion of the at least one receiving structure at the base portion, and wherein engagement of the at least one protruding structure at the base end of the handle portion with the portion of the at least one receiving structure at the base portion precludes outward movement of the base end of the handle portion and pivotal movement of the crank.

2. The vehicular exterior door handle assembly of claim 1, wherein the crank locking mechanism comprises at least two protruding structures at the base end of the handle portion and at least one receiving structure at the base portion.

3. The vehicular exterior door handle assembly of claim 1, wherein the at least one protruding structure at the base end of the handle portion comprises two opposing pins that protrude toward one another inward from opposite sides of the base end of the handle portion, and wherein the at least one receiving structure at the base portion comprises two slots that are configured to receive the respective pins when the base end of the handle portion is manually moved inward to cause the swing end of the handle portion to move outward toward the manually deployed position.

4. The vehicular exterior door handle assembly of claim 1, wherein the handle portion comprises a core portion and a handle cap that attaches at the core portion to cover mounting pins that pivotally attach the handle portion to the crank and the bellcrank link.

5. The vehicular exterior door handle assembly of claim 1, wherein the vehicular exterior door handle assembly is mounted at the door handle region of one selected from the group consisting of (a) a side door of the vehicle, (b) a rear door of the vehicle, and (c) a liftgate of the vehicle.

6. The vehicular exterior door handle assembly of claim 1, wherein the handle portion, when in the recessed position, is received in the base portion so as to be not graspable by a user until the handle portion is moved toward the deployed position.

7. The vehicular exterior door handle assembly of claim 1, wherein the input signal comprises at least one selected from the group consisting of (a) a signal from a passive entry device, (b) a signal from a remote transmitting device, and (c) a signal indicative of a user actuating a door unlock button of the vehicle door.

8. The vehicular exterior door handle assembly of claim 1, wherein outward movement of the base end of the handle portion imparts outward movement of the swing end of the handle portion, such that the handle portion moves outward from the door handle region while remaining parallel to the door handle region of the vehicle door.

9. The vehicular exterior door handle assembly of claim 8, wherein, when the handle portion is at the deployed position or the manually deployed position, manual movement of the swing end of the handle portion to actuate the door latch moves the swing end relative to the base portion and pivots the bellcrank via pulling action at the bellcrank link.

10. A vehicular exterior door handle assembly, the vehicular exterior door handle assembly comprising:

a base portion disposed at a door handle region of a vehicle door of a vehicle;

a handle portion including a base end, a swing end, and a grasping portion disposed between the base end and the swing end, wherein the handle portion is movable relative to the base portion between a recessed position, where the handle portion is recessed at the base portion so as to be not graspable by a user, and a deployed position, where the handle portion protrudes outward from the base portion to be graspable by the user;

a crank that pivotally connects the base end of the handle portion to the base portion;

a bellcrank that is pivotally mounted at the base portion and that is coupled with a door latch of the vehicle;

a bellcrank link that pivotally connects the swing end of the handle portion to the bellcrank;

an actuator including a motor that is electrically operable in response to an input signal;

wherein, responsive to the input signal, the motor operates and the actuator engages a portion of the crank to impart pivotal movement of the crank to cause the crank to pivot relative to the base portion and move the handle portion from the recessed position toward the deployed position, and wherein, as the crank pivots to move the base end of the handle portion, the bellcrank link pivots relative to the bellcrank and the base portion to move the swing end of the handle portion;

wherein outward movement of the base end of the handle portion imparts outward movement of the swing end of the handle portion, such that the handle portion moves outward from the door handle region while remaining parallel to the door handle region of the vehicle door;

wherein, when the handle portion is at the deployed position, the swing end of the handle portion is manually movable further outward from the base portion to move the bellcrank link outward from the base portion to impart pivotal movement of the bellcrank relative to the base portion to actuate the door latch;

wherein, when the handle portion is at the recessed position, the base end of the handle portion is manually movable inward to cause the swing end of the handle portion to move outward from the base portion to move the handle portion toward a manually deployed position without operation of the motor;

wherein, when the handle portion is at the deployed position or the manually deployed position, manual movement of the swing end of the handle portion to actuate the door latch moves the swing end relative to the base portion and pivots the bellcrank via pulling action at the bellcrank link;

a crank locking mechanism that limits pivotal movement of the crank when the handle portion is in the manually deployed position;

wherein the crank locking mechanism comprises at least one protruding structure at the base end of the handle portion and at least one receiving structure at the base portion, and wherein the at least one receiving structure is configured to receive the at least one protruding structure when the base end of the handle portion is manually moved inward to cause the swing end of the handle portion to move outward toward the manually deployed position; and wherein, when the handle portion is in the manually deployed position and is pulled by the user to open the vehicle door, the at least one protruding structure at the base end of the handle portion engages a portion of the at least one receiving structure at the base portion, and wherein engagement of the at least one protruding structure at the base end of the handle portion with the portion of the at least one receiving structure at the base portion precludes outward movement of the base end of the handle portion and pivotal movement of the crank.

11. The vehicular exterior door handle assembly of claim 10, wherein the handle portion comprises a core portion and a handle cap that attaches at the core portion to cover mounting pins that pivotally attach the handle portion to the crank and the bellcrank link.

12. The vehicular exterior door handle assembly of claim 10, wherein the crank locking mechanism comprises at least two protruding structures at the base end of the handle portion and at least one receiving structure at the base portion.

13. The vehicular exterior door handle assembly of claim 10, wherein the at least one protruding structure at the base end of the handle portion comprises two opposing pins that protrude toward one another from opposite sides of the base end of the handle portion, and wherein the at least one receiving structure at the base portion comprises two slots that are configured to receive the respective pins therein when the base end of the handle portion is manually moved inward to cause the swing end of the handle portion to move outward toward the manually deployed position.

14. A vehicular exterior door handle assembly, the vehicular exterior door handle assembly comprising:

a base portion disposed at a door handle region of a vehicle door of a vehicle;

a handle portion including a base end, a swing end, and a grasping portion disposed between the base end and the swing end, wherein the handle portion is movable relative to the base portion between a recessed position, where the handle portion is recessed at the base portion so as to be not graspable by a user, and a deployed position, where the handle portion protrudes outward from the base portion to be graspable by the user;

a crank that pivotally connects the base end of the handle portion to the base portion;

a bellcrank that is pivotally mounted at the base portion and that is coupled with a door latch of the vehicle;

a bellcrank link that pivotally connects the swing end of the handle portion to the bellcrank;

an actuator including a motor that is electrically operable in response to an input signal;

wherein, responsive to the input signal, the motor operates and the actuator engages a portion of the crank to impart pivotal movement of the crank to cause the crank to pivot relative to the base portion and move the handle portion from the recessed position toward the deployed position, and wherein, as the crank pivots to move the base end of the handle portion, the bellcrank link pivots relative to the bellcrank and the base portion to move the swing end of the handle portion;

wherein, when the handle portion is at the deployed position, the swing end of the handle portion is manually movable further outward from the base portion to move the bellcrank link outward from the base portion to impart pivotal movement of the bellcrank relative to the base portion to actuate the door latch;

wherein, when the handle portion is at the recessed position, the base end of the handle portion is manually movable inward to cause the swing end of the handle portion to move outward from the base portion to move the handle portion toward a manually deployed position without operation of the motor;

a crank locking mechanism that limits pivotal movement of the crank when the handle portion is in the manually deployed position;

wherein the crank locking mechanism comprises (i) a pin that protrudes from a side of the base end of the handle portion and (ii) a slot at the base portion that is configured to receive the pin when the handle portion is pivoted toward the manually deployed position;

wherein, when the base end of the handle portion is manually moved inward to the manually deployed position, the pin moves into the slot to limit outward movement of the base end of the handle portion and pivotal movement of the crank; and wherein, when the handle portion is in the manually deployed position and is pulled by the user to open the vehicle door, the pin engages a portion of the slot, and wherein engagement of the pin with the portion of the slot precludes outward movement of the base end of the handle portion and pivotal movement of the crank.

15. The vehicular exterior door handle assembly of claim 14, wherein the handle portion comprises a core portion and a handle cap that attaches at the core portion to cover mounting pins that pivotally attach the handle portion to the crank and the bellcrank link.

16. The vehicular exterior door handle assembly of claim 14, wherein the handle portion, when in the recessed position, is received in the base portion so as to be not graspable by a user until the handle portion is moved toward the deployed position.

17. The vehicular exterior door handle assembly of claim 14, wherein outward movement of the base end of the handle portion imparts outward movement of the swing end of the handle portion, such that the handle portion moves outward from the door handle region while remaining parallel to the door handle region of the vehicle door.

18. The vehicular exterior door handle assembly of claim 17, wherein, when the handle portion is at the deployed position or the manually deployed position, manual movement of the swing end of the handle portion to actuate the door latch moves the swing end relative to the base portion and pivots the bellcrank via pulling action at the bellcrank link.

* * * * *